US009214747B2

(12) United States Patent
Gerald McHugh

(10) Patent No.: US 9,214,747 B2
(45) Date of Patent: Dec. 15, 2015

(54) LOW PROFILE ELECTRICAL CONNECTOR HAVE A FPC

(71) Applicant: HON HAI PRECISION INDUSTRY CO., LTD., New Taipei (TW)

(72) Inventor: Robert Gerald McHugh, Everygreen, CO (US)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 238 days.

(21) Appl. No.: 13/893,360

(22) Filed: May 14, 2013

(65) Prior Publication Data

US 2014/0342583 A1 Nov. 20, 2014

(51) Int. Cl.

*H01R 12/71* (2011.01)
*H01R 12/57* (2011.01)
*H01R 12/62* (2011.01)

(52) U.S. Cl.

CPC ..... *H01R 12/716* (2013.01); *H01R 12/57* (2013.01); *H01R 12/62* (2013.01)

(58) Field of Classification Search

CPC .. H01R 12/714; H01R 12/716; H01R 12/523; H01R 13/2414; H01R 12/57; H01R 12/62; H01R 12/52; H01R 12/87; H01R 23/72

USPC ..... 439/67–83

See application file for complete search history.

(56) References Cited

U.S. PATENT DOCUMENTS

| | | | | | |
|---|---|---|---|---|---|
| 4,552,422 | A * | 11/1985 | Bennett et al. | 439/69 |
| 5,859,538 | A * | 1/1999 | Self | 324/754.07 |
| 6,142,609 | A * | 11/2000 | Aoki | 347/50 |
| 6,144,559 | A * | 11/2000 | Johnson et al. | 361/760 |
| 6,224,396 | B1 * | 5/2001 | Chan et al. | 439/71 |
| 6,830,460 | B1 * | 12/2004 | Rathburn | 439/66 |
| 6,971,887 | B1 * | 12/2005 | Trobough | 439/71 |
| 7,371,077 | B1 * | 5/2008 | McHugh et al. | 439/71 |
| 2002/0137365 | A1 * | 9/2002 | McGrath et al. | 439/71 |
| 2003/0201462 | A1 * | 10/2003 | Pommer et al. | 257/200 |
| 2004/0252477 | A1 * | 12/2004 | Brown et al. | 361/830 |
| 2005/0170627 | A1 * | 8/2005 | Mowry et al. | 438/612 |
| 2006/0065972 | A1 * | 3/2006 | Khan et al. | 257/712 |
| 2008/0139020 | A1 * | 6/2008 | Weiss | 439/91 |
| 2012/0083169 | A1 * | 4/2012 | Heng et al. | 439/660 |

FOREIGN PATENT DOCUMENTS

| | | |
|---|---|---|
| TW | M339195 | 8/2008 |

* cited by examiner

*Primary Examiner* — Briggitte R Hammond

(74) *Attorney, Agent, or Firm* — Wei Te Chung; Ming Chieh Chang

(57) ABSTRACT

An electrical connector electrically connecting a chip module to a printed circuit board includes an insulative housing with a number of terminals therein and includes a substrate and a sidewall extending upwardly from the substrate, the substrate includes a top surface, a bottom surface opposite to the top surface and a number of through holes penetrated from the top surface to the bottom surface, wherein the electrical connector further includes a flex film located under the substrate, a frame located above the flex film and a number of solder balls electrically connecting the flex film to the printed circuit board, the four sides of the flex film and the frame are both insert-molded into the insulative housing.

19 Claims, 6 Drawing Sheets

LOW PROFILE ELECTRICAL CONNECTOR HAVE A FPC

FIELD OF THE INVENTION

The present invention relates to an electrical connector, and more particularly to an electrical connector having a Flexible Printed Circuit (FPC) that makes it easier for both a lower height and the fine pitch.

DESCRIPTION OF THE PRIOR ART

As the recent technology show, the size of the electrical connector becomes more and more smaller and the height of the electrical connector becomes more and more lower, but the number of the terminals becomes much more, so the distance of the terminals should becomes smaller and it is need to get an electrical connector that is to be a low profile and fine pitch to solve this question.

A strengthen structure of a frame is described in Tai Wan Patent No. M339195, issued to HSU et al. on Aug. 21, 2008. The structure comprises a first base and a second base, the first base is plasticity material and the second base is rigidity material. The first base and the second base are insert-molded. The second base strengthens the strength of the structure, but it can not reduce the height of the frame.

Therefore, it is needed to find a new electrical socket to overcome the problems mentioned above.

SUMMARY OF THE INVENTION

Accordingly, an object of the present invention is to provide an electrical connector electrically connecting stably.

In order to achieve the object set forth, an electrical connector electrically connecting a chip module to a printed circuit board, the electrical connector comprises an insulative housing with a plurality of terminals therein, the insulative housing comprises a substrate and a sidewall extending upwardly from the substrate, the substrate comprises a top surface, a bottom surface opposite to the top surface and a plurality of through holes penetrated from the top surface to the bottom surface, wherein the electrical connector further comprises a flex film located under the substrate, a frame located above the flex film and a plurality of solder balls electrically connecting the flex film to the printed circuit board, the four sides of the flex film and the frame are both insert-molded into the insulative housing.

DESCRIPTION OF PREFERRED EMBODIMENT

Reference will now be made to the drawings to describe the present invention in detail.

Figure 1:
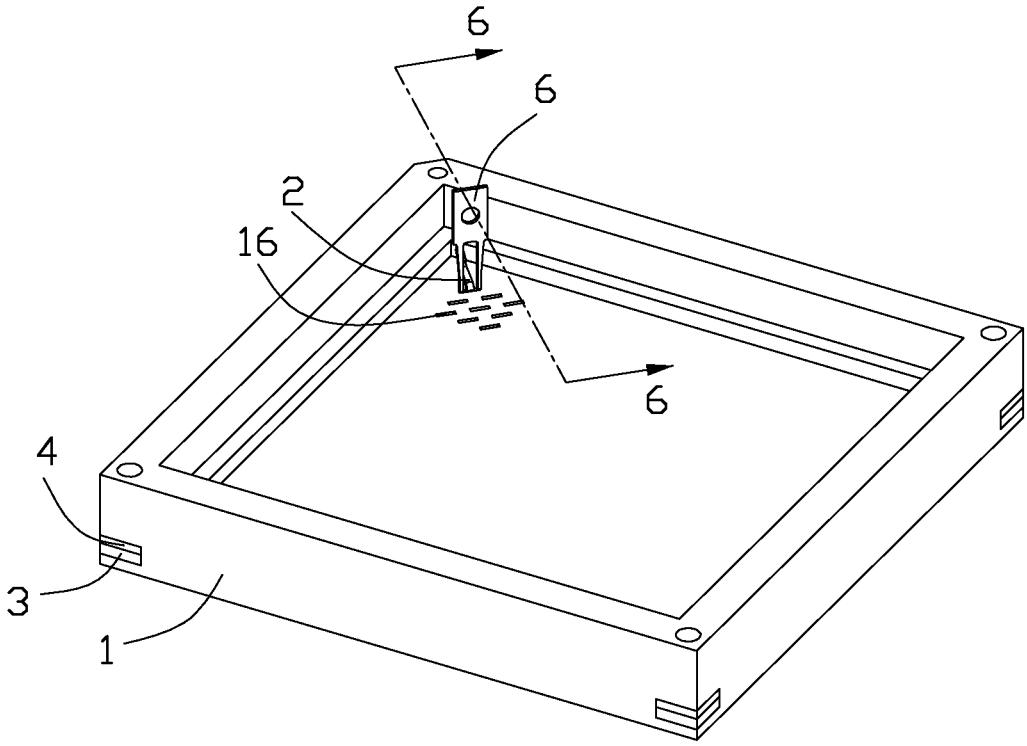
FIG. 1 is an isometric, assembled view of an electrical connector in accordance with a preferred embodiment of the present invention.
Figure 2:
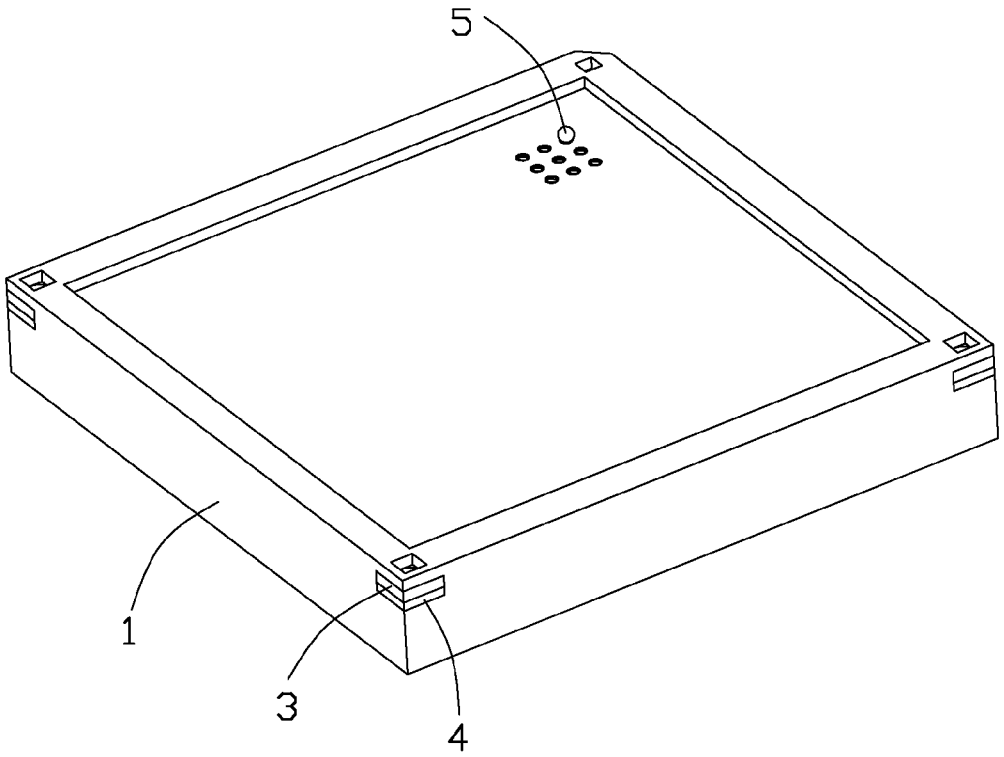
FIG. 2 is another isometric, assembled view of an electrical connector as shown in FIG. 1.
Figure 3:
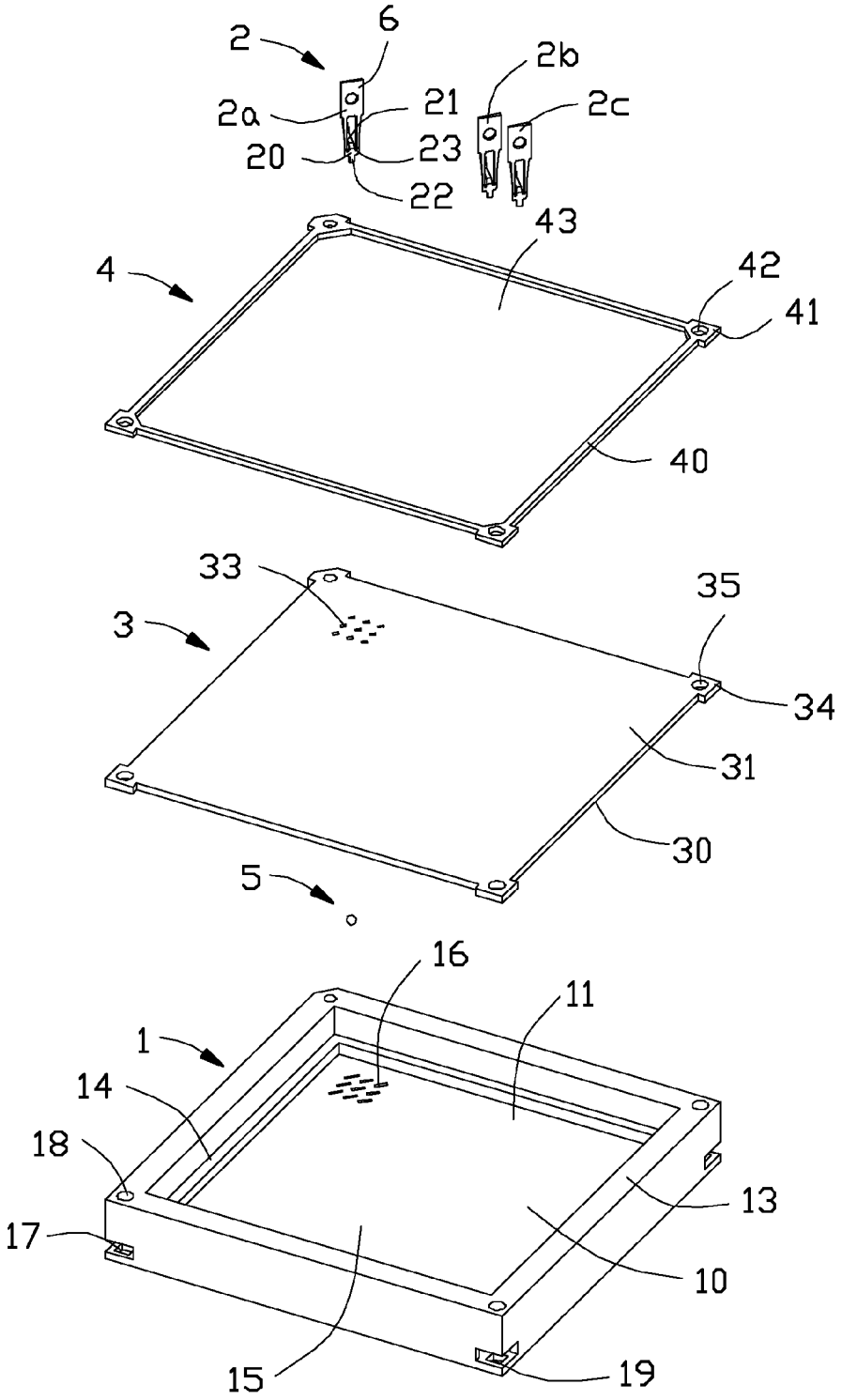
FIG. 3 is an isometric, exploded view of the electrical connector as shown in FIG. 1.

Referring to FIGS. 1-3, an electrical connector 100 according to the present invention is used to electrically connecting a chip module to a printed circuit board (not show) and comprises an insulative housing 1 with a plurality of terminals 2 received therein, a FPC 3 received in the insulative housing 1, a frame 4 attached on the FPC 3 and received in the insulative housing 1 and a plurality of solder balls 5 used for electrically connecting the terminals 2 to the printed circuit board.

Figure 4:
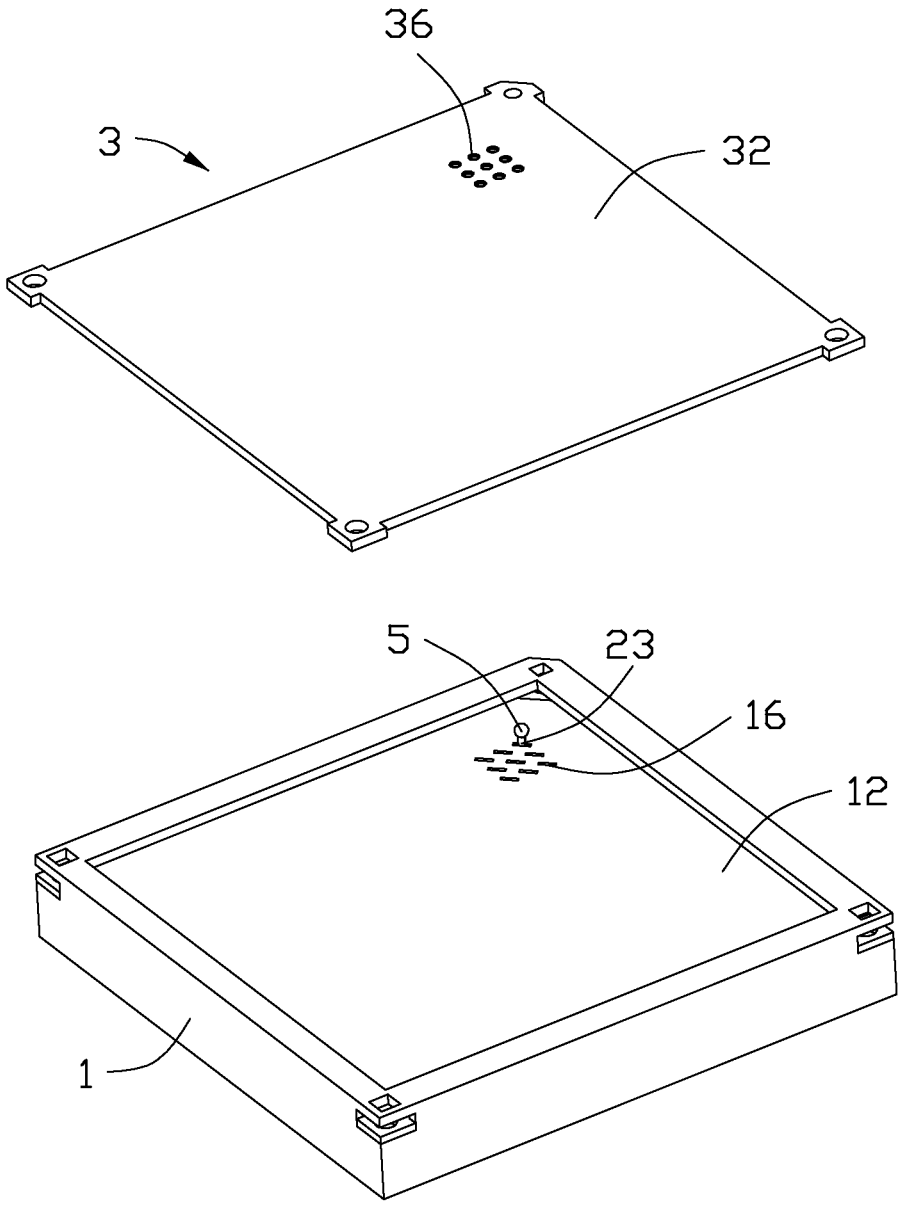
FIG. 4 is another isometric, exploded view of the electrical connector as shown in FIG. 3.
Figure 5:
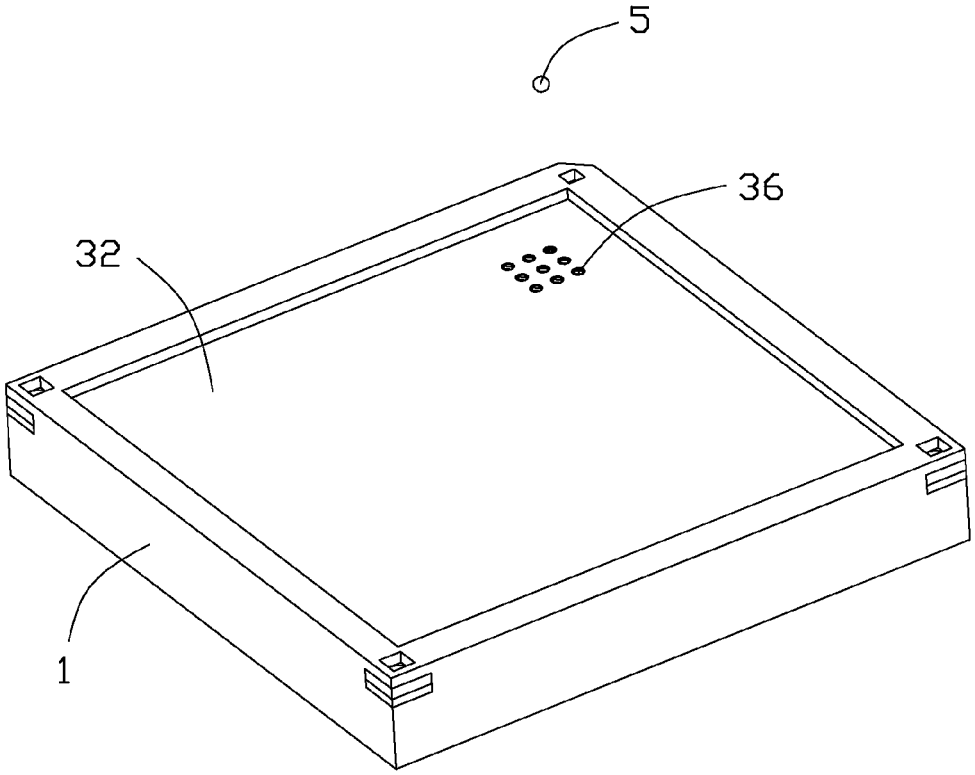
FIG. 5 is an isometric, assembled view of the electrical connector that the solder ball is exploded as shown in FIG. 2.
Figure 6:
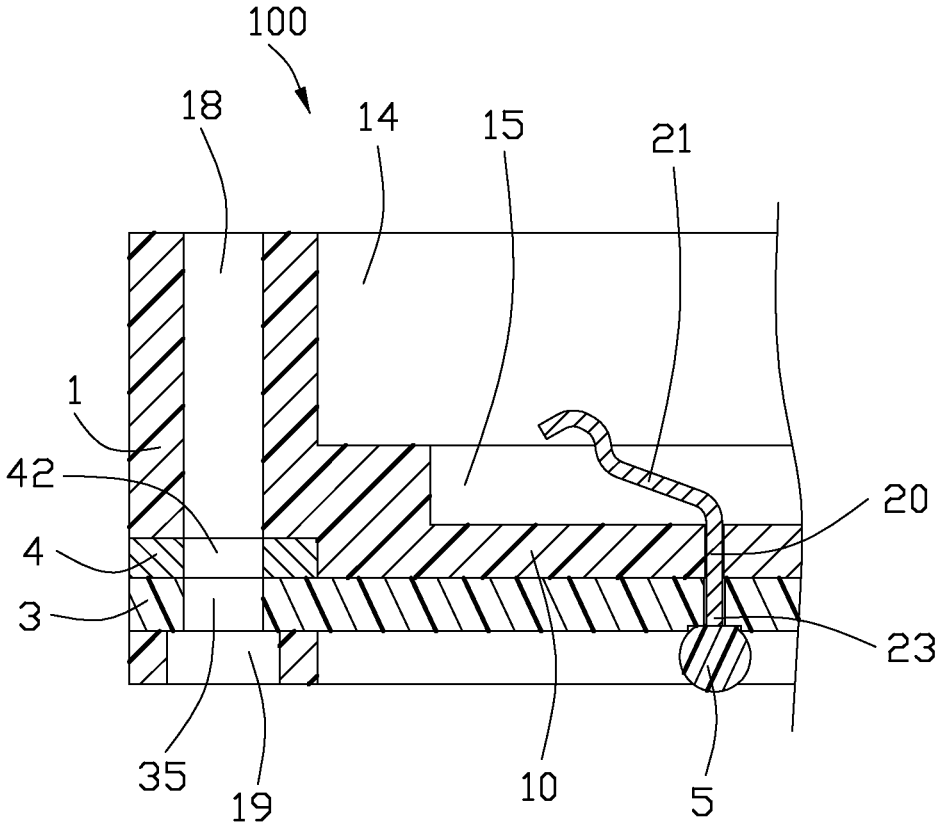
FIG. 6 is a cross-sectional view of the electrical connector without the carrier taken along line 6-6 in FIG. 1.

Referring to FIGS. 3-4, the insulative housing 1 is made of insulating material, and comprises a base 10 and a sidewall 13 extending upwardly from the four side edges of the base 10. The electrical connector 100 further comprises a space 14 surrounded by the sidewall 13 for receiving the chip module. The base 10 comprises a top surface 11, a bottom surface 12 opposite to the top surface 11 and a plurality of receiving holes 16 for receiving the terminals 2. The base 10 comprises a receiving room 15 depressed from the top surface 11 of the base 10 for dissipating the heat that occurs from the chip module and four receiving slots 17 depressed from the sidewall 13 to inner of the four corners of the insulative housing 1. The base 10 also comprises four retention holes 18 that the fixing elements (not show) can passe through and four fixing holes 19 penetrated from the bottom surface 12 to the receiving slots 17. The receiving holes 16 are configured with lengthwise shape and the receiving holes 16 are arranged in a slant direction relative to the sidewall 13 of the insulative housing 1.

Referring to FIGS. 3-4, the FPC 3 is made of insulating material, and comprises a main body 30 configured with a tabulate shape, four ear portions 34 protruding from four corners of the main body 30. The main body 30 has a first surface 31, a second surface 32 opposite to the first surface 31, a plurality of first holes 33 depressed from the first surface 31, a plurality of second holes 36 depressed from the second surface 32 and four matching holes 35 running through from the first surface 31 to the second surface 32. The second hole 32 is a circle shape and corresponding to the solder ball 5.

Referring to FIGS. 3-4, the frame 4 is made of metal material, and in accordance with a preferred embodiment of the present invention is a metal stiffener. The frame 4 comprises a body portion 40, four corner portions 41 protruding from four corners of the body portion 40, a hollow portion 43 surrounded by the body portion 40 and four corresponding holes 42 corresponding to the matching holes 35 that the fixing elements can pass through.

Referring to FIG. 1 to FIG. 6, each of the terminals 2, only one shown as a representative, comprises a base portion 20, a spring beam 21 extending upwardly from the base portion 20, a soldering portion 22 extending downwardly from the base portion 20 and a retention portion 23 extending outwardly from two sides of the base portion 20. The base portion 20 received in the base 10 and the base portion 20 also passed through the first hole 33 and the second hole 36. The spring beam 21 received in the receiving room 15 of the insulative housing 1.

Referring to FIGS. 1-4 and FIG. 6, the electrical connector 100 further comprises a carrier 6 connected with the retention portion 23 of the terminal 2. When assembling the electrical connector 100, the four sides of the FPC 3 and the frame 4 are insert-molded into the insulative housing 1, the terminals 2 are inserted into the insulative housing 1 by row. The arrangement of the terminals 2 can save room and it improved the density of the terminals 2. The frame 4 embedded into the insulative housing 1 and it increases the strength of the insulative housing 1. The FPC 3 also embedded into the insulative housing 1 and located below the base 10, and it helps to reduce the height of the electrical connector 1. The FPC 3 is downward exposed to an exterior. The via of the FPC 3 helps to locate the solder ball 5 in the correct position and it allows the solder ball 5 to center itself for better true position. The solder ball 5 is fused into the via of the FPC 3 from the bottom side of the FPC 3 and the corresponding soldering portion 22 is fused into the same via from the upper side of the FPC 3. The FPC 3 could be used to link terminals 2 together for power or shielding, etc. if needed. The FPC 3 and the frame 4 are insert-molded into the insulative housing 1 and it is cost effective and easy way to attach the solder ball 5 to the terminal 2.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for electrically connecting a chip module to a printed circuit board comprising:

an insulative housing with a plurality of terminals therein and comprising a base and a sidewall extending upwardly from four sides of the base; and a plurality of solder balls used for connecting the terminals to the printed circuit board; wherein the electrical connector further comprises a flex film located around a bottom portion of the base and a frame attached to the flex film, the frame and four sides of the flex film are located within a contour of the base, and at least one of the terminals passing through the flex film and electrically connecting the flex film to the solder ball.

2. The electrical connector as claimed in claim 1, wherein said flex film is a Flexible Printed Circuit.

3. The electrical connector as claimed in claim 1, wherein said frame is a metal stiffener.

4. The electrical connector as claimed in claim 1, wherein said frame and four sides of the flex film are embedded in the base of the insulative housing.

5. The electrical connector as claimed in claim 1, wherein said base comprises a plurality of receiving holes for receiving the terminals, the receiving holes are configured in lengthwise and the receiving holes are arranged in a slant direction relative to the sidewall of the insulative housing.

6. The electrical connector as claimed in claim 1, wherein each of the terminals comprises a base portion, a spring beam extending upwardly from the base portion, a soldering portion extending downwardly from the base portion and a retention portion extending outwardly from two sides of the base portion.

7. The electrical connector as claimed in claim 6, wherein said insulative housing comprises a space surrounded by the sidewall for receiving the chip module, the base comprises a receiving room depressed from the top surface of the base to receive the spring beam of the terminal.

8. The electrical connector as claimed in claim 1, wherein said flex film is downward exposed to.

9. An electrical connector electrically comprising:

an insulative housing with a plurality of terminals therein and comprising a substrate and a sidewall extending upwardly from the substrate; and the substrate comprises a top surface, a bottom surface opposite to the top surface and a plurality of through holes penetrated from the top surface to the bottom surface; wherein the electrical connector further comprises a flex film located under the substrate, a frame located above the flex film and a plurality of solder balls electrically connecting the flex film to the printed circuit board, and four sides of the flex film and the frame are both insert-molded into the insulative housing.

10. The electrical connector as claimed in claim 9, wherein said flex film is downward exposed.

11. The electrical connector as claimed in claim 9, wherein said flex film is a Flexible Printed Circuit and the frame is a metal stiffener.

12. The electrical connector as claimed in claim 9, wherein said substrate comprises a plurality of receiving holes for receiving the terminals, the receiving holes are configured with lengthwise shape and the receiving holes are arranged in a slant direction relative to the sidewalls of the insulative housing.

13. The electrical connector as claimed in claim 9, wherein each of the terminals comprises a base portion, a spring beam extending upwardly from the base portion, a soldering portion extending downwardly from the base portion and a retention portion extending outwardly from two sides of the base portion.

14. The electrical connector as claimed in claim 10, wherein said insulative housing comprises a space surrounded by the sidewall for receiving the chip module and the base comprises a receiving room depressed from the top surface of the base to receive the spring beam of the terminal.

15. An electrical connector assembly comprising:

an insulative housing defining a horizontal base with a plurality side walls to commonly define an upward receiving space for receiving an electronic package;

a plurality of contacts disposed in the housing, each of said contacts defining an upper resilient contacting section extending into the receiving space for contacting the electronic package, and a lower tail below an undersurface of the base; and a flexible printed circuit (FPC) intimately located under the base and equipped with vias each defining a rim structure compliantly receiving an upper part of a corresponding solder ball so as to confine the corresponding solder ball before a tip of the tail is fused with the corresponding solder ball in the corresponding via.

16. The electrical connector assembly as claimed in claim 15, further including a frame surrounding the FPC and securely attached to the housing.

17. The electrical connector assembly as claimed in claim 15, wherein said terminals are categorized with signal terminals and grounding terminals, and the vias connected to the grounding terminals are electrically linked together while the signal terminals are not.

18. The electrical connector assembly as claimed in claim 15, wherein said terminals are categorized with signal terminals and power terminals, and the vias connected to the power terminals are electrically linked together while the signal terminals are not.

19. The electrical connector assembly as claimed in claim 15, wherein the FPC is structured with a portion to interfere with the corresponding tail above the corresponding rim structure of each of said vias.

* * * * *